US009484660B2

(12) United States Patent
Shuey et al.

(10) Patent No.: US 9,484,660 B2
(45) Date of Patent: Nov. 1, 2016

(54) ELECTRICAL CONNECTOR

(71) Applicant: Tyco Electronics Corporation, Berwyn, PA (US)

(72) Inventors: John Raymond Shuey, Mechanicsburg, PA (US); Galen M. Martin, Mechanicsburg, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/540,438

(22) Filed: Nov. 13, 2014

(65) Prior Publication Data

US 2016/0141788 A1 May 19, 2016

(51) Int. Cl.
*H01R 13/50* (2006.01)
*H01R 13/436* (2006.01)

(52) U.S. Cl.
CPC ..... *H01R 13/501* (2013.01); *H01R 13/4362* (2013.01)

(58) Field of Classification Search
CPC ..... H01R 13/501
USPC ..... 439/752, 596
See application file for complete search history.

(56) References Cited

U.S. PATENT DOCUMENTS 4,045,110 A * 8/1977 Sterken ..... H01R 13/436 439/345
4,443,048 A * 4/1984 Moist, Jr. ..... H01R 43/20 439/599
4,544,220 A * 10/1985 Aiello ..... H01R 13/424 439/594
4,708,662 A * 11/1987 Klein ..... H01R 13/6273 439/353
4,721,482 A * 1/1988 Fukuda ..... H01R 13/4223 439/586
4,784,617 A * 11/1988 Oda ..... H01R 13/4364 439/595
4,846,737 A * 7/1989 Jorroch ..... H01R 13/436 439/686
4,944,688 A * 7/1990 Lundergan ..... H01R 13/5221 439/275
4,973,268 A * 11/1990 Smith ..... H01R 13/443 439/589
4,979,913 A * 12/1990 Aiello ..... H01R 13/422 439/596
4,988,307 A 1/1991 Muzslay
5,035,648 A * 7/1991 Kuiper-Moore ..... H01R 13/424 439/595
5,067,913 A * 11/1991 Sagawa ..... H01R 13/4223 439/595
5,108,319 A * 4/1992 Tsuji ..... H01R 13/4368 439/595
5,120,269 A * 6/1992 Endo ..... H01R 13/4368 439/595
5,145,419 A * 9/1992 Yamanashi ..... H01R 13/4368 439/595

(Continued)

FOREIGN PATENT DOCUMENTS

JP H06 325814 A 11/1994

OTHER PUBLICATIONS

European Search Report, Mail Date, Mar. 11, 2016, EP 15 19 3263, Application No. 15193263.9-1801.

*Primary Examiner* — Ross Gushi

(57) ABSTRACT

An electrical connector includes a housing including a front housing and a rear housing matable to define the housing. The front housing and the rear housing are molded as a single piece with a hinge member connecting the front housing and the rear housing. The rear housing is rotatable about the hinge member from an open position to a closed position. The front housing has front terminal channels configured to receive terminals and the rear housing has rear terminal channels aligned with the front terminal channels when the rear housing is rotated to the closed position but not aligned with the front terminal channels when the rear housing is in the open position. The rear terminal channels are configured to allow the terminals to at least partially pass therethrough into the front terminal channels during loading of the terminals into the housing.

19 Claims, 3 Drawing Sheets

(56) References Cited

U.S. PATENT DOCUMENTS 5,273,456 A * 12/1993 Muzslay ..... H01R 13/641 439/188
5,292,262 A * 3/1994 Endo ..... H01R 13/4223 439/595
5,316,504 A * 5/1994 Jinno ..... H01R 13/4362 439/595
5,342,223 A 8/1994 Geib
5,358,427 A * 10/1994 Miwa ..... H01R 13/4362 439/595
5,358,431 A * 10/1994 Yamamoto ..... H01R 13/4368 439/595
5,397,249 A * 3/1995 Endo ..... H01R 13/4368 439/595
5,435,758 A * 7/1995 Sasai ..... H01R 13/4368 439/752
5,439,397 A * 8/1995 Yamanashi ..... H01R 13/4368 439/752
5,441,427 A * 8/1995 Yamada ..... H01R 13/4367 439/686
5,458,511 A * 10/1995 Sasai ..... H01R 13/4368 403/326
5,460,550 A * 10/1995 Okayasu ..... H01R 13/4362 439/752
5,498,177 A * 3/1996 Tsuji ..... H01R 13/4223 439/596
5,501,619 A * 3/1996 Sakatani ..... H01R 13/4368 439/596
5,562,495 A * 10/1996 Kakitani ..... H01R 13/4223 439/595
5,567,184 A * 10/1996 Sasai ..... H01R 43/20 439/752
5,618,203 A * 4/1997 Koumatsu ..... H01R 13/4223 439/546
5,643,009 A * 7/1997 Dinkel ..... H01R 13/424 439/595
5,653,613 A * 8/1997 Shimoda ..... H01R 13/4361 439/752
5,669,791 A * 9/1997 Endo ..... H01R 13/4362 439/752
5,697,819 A * 12/1997 Hatagishi ..... H01R 13/501 439/752
5,700,162 A * 12/1997 Hatagishi ..... H01R 13/422 439/595
5,700,163 A * 12/1997 Okabe ..... H01R 13/501 439/596
5,713,756 A * 2/1998 Abe ..... H01R 13/501 439/404
5,716,233 A * 2/1998 Muzslay ..... H01R 13/4364 439/595
5,769,670 A * 6/1998 Abe ..... H01R 13/4362 439/752
5,797,772 A * 8/1998 Sakurai ..... H01R 13/4362 439/752
5,803,773 A * 9/1998 Kashiyama ..... H01R 13/4368 439/752
5,827,093 A * 10/1998 Okabe ..... H01R 13/506 439/596
5,860,834 A * 1/1999 Sugiyama ..... H01R 13/4361 439/595
5,865,653 A * 2/1999 Okada ..... H01R 13/4362 439/752
5,941,737 A * 8/1999 Sakai ..... H01R 13/4223 439/752
5,997,365 A * 12/1999 Abe ..... H01R 13/506 439/598
6,024,605 A * 2/2000 Beck, Jr. ..... H01R 13/424 439/595
6,027,374 A * 2/2000 Nagai ..... H01R 13/4361 439/596
6,050,861 A * 4/2000 Genta ..... H01R 13/4362 439/752
6,093,063 A * 7/2000 Tsuji ..... H01R 13/4361 439/595
6,183,313 B1 * 2/2001 Kashiyama ..... H01R 13/4361 439/752
6,231,350 B1 * 5/2001 Vives Clavel ..... H01R 31/08 439/40
6,250,972 B1 * 6/2001 Shinchi ..... H01R 13/504 439/465
6,296,531 B1 * 10/2001 Nagamine ..... H01R 13/4362 439/595
6,328,613 B1 * 12/2001 Kashiyama ..... H01R 13/4362 439/752
6,338,638 B2 * 1/2002 Kodama ..... H01R 13/4362 439/246
6,368,165 B2 * 4/2002 Kubo ..... H01R 13/4362 439/746
6,390,859 B2 * 5/2002 Furutani ..... H01R 13/4362 439/752
6,398,585 B1 * 6/2002 Fukuda ..... H01R 13/5208 439/587
6,412,169 B1 * 7/2002 Endo ..... H01R 13/4367 29/874
6,443,767 B1 * 9/2002 Nagai ..... H01R 13/501 439/596
6,464,544 B1 * 10/2002 Yamamoto ..... H01R 13/4367 439/595
6,482,035 B2 * 11/2002 Okabe ..... H01R 4/2433 439/596
6,485,333 B1 * 11/2002 Shinchi ..... H01R 13/504 174/77 R
6,494,740 B1 * 12/2002 Murakami ..... H01R 13/5208 439/275
6,572,415 B1 * 6/2003 Kashiyama ..... B29C 45/0046 439/606
6,604,966 B1 * 8/2003 Hayes ..... H01R 12/592 439/459
6,632,392 B2 * 10/2003 Kashiyama ..... B29C 45/0046 264/328.1
6,648,699 B1 * 11/2003 Makino ..... H01R 13/4362 439/595
6,769,940 B2 * 8/2004 Nakano ..... H01R 13/43662 439/752
6,780,070 B2 * 8/2004 Ishikawa ..... H01R 13/4362 439/752
6,854,999 B2 * 2/2005 Patel ..... H01R 13/53 439/474
6,869,555 B2 * 3/2005 Kashiyama ..... H01R 13/4368 264/238
7,001,206 B2 * 2/2006 Sakurai ..... H01R 13/4362 439/489
7,004,791 B2 * 2/2006 Mumper ..... H01R 43/18 439/595
7,351,117 B1 * 4/2008 Mostoller ..... H01R 13/428 439/744
7,637,785 B2 * 12/2009 Irish ..... H01R 13/6315 439/658
7,682,180 B2 3/2010 Brown et al.
7,892,048 B2 * 2/2011 Shi ..... H01R 13/4367 439/752
8,147,279 B1 4/2012 Martin et al.
8,430,689 B2 4/2013 Myer et al.
8,651,901 B2 2/2014 Beck, Jr. et al.
8,986,037 B2 * 3/2015 Boemmel ..... H01R 13/4361 439/357
9,022,813 B2 * 5/2015 Wilkner ..... H01R 13/4361 439/701
9,070,999 B2 * 6/2015 Endo ..... H01R 13/506

* cited by examiner

ELECTRICAL CONNECTOR

BACKGROUND OF THE INVENTION

The subject matter herein relates generally to electrical connectors holding terminals.

In various applications of electrical connectors, devices are utilized to lock terminals in place and to assure that the terminals are in proper position within the electrical connector. Such electrical connectors are typically used in harsh environments, such as automotive applications, in which the electrical connectors are subject to vibration and other forces that may tend to have the terminals back out of the connectors.

Currently, certain electrical connectors are provided with housings having cavities extending therethrough for receiving terminals. The terminals are locked in the cavities by a primary latch, which may be part of the housing or part of the terminal itself. In order to mold the latches and other complicated features into the housing that secure the terminals in the terminal cavities, the housings are typically manufactured from two housings or shells that are coupled together. Furthermore, the electrical connectors typically include a secondary lock that acts as a backup locking feature should the primary lock fail. Such secondary locks are typically a separate piece. Moreover, the electrical connectors typically include a terminal position assurance device that is used to assure that the terminals are properly positioned in the cavities. Such terminal position assurance devices are typically a separate piece, but may be part of the secondary lock. Assembly requires picking up both housing pieces, the secondary lock and/or the terminal position assurance device, aligning them and mating them together. Such assembly is labor intensive and time consuming. Additionally, the parts are typically molded in separate molds, thereby increasing the manufacturing time for the housing.

A need remains for an electrical connector that includes locking features to secure terminals therein that may be manufactured and assembled in a cost effective and reliable manner.

BRIEF DESCRIPTION OF THE INVENTION

In one embodiment, an electrical connector is provided that includes a housing including a front housing and a rear housing matable to define the housing. The front housing and the rear housing are molded as a single piece with a hinge member connecting the front housing and the rear housing. The rear housing is rotatable about the hinge member from an open position to a closed position. The front housing has front terminal channels configured to receive terminals and the rear housing has rear terminal channels aligned with the front terminal channels when the rear housing is rotated to the closed position but not aligned with the front terminal channels when the rear housing is in the open position. The rear terminal channels are configured to allow the terminals to at least partially pass therethrough into the front terminal channels during loading of the terminals into the housing.

In another embodiment, an electrical connector is provided that includes a housing including a front housing and a rear housing matable to define the housing. The front housing and the rear housing are molded as a single piece with a hinge member connecting the front housing and the rear housing. The rear housing is rotatable about the hinge member from an open position to a closed position. The front housing has front terminal channels configured to receive terminals and the rear housing has rear terminal channels aligned with the front terminal channels when the rear housing is rotated to the closed position but not aligned with the front terminal channels when the rear housing is in the open position. After the rear housing is moved to the closed position, the rear housing is movable from an unlocked position to a locked position. In the unlocked position, the rear terminal channels are aligned with the front terminal channels to allow terminals to freely pass between the rear terminal channels and the front terminal channels. In the locked position, the rear housing blocks the terminals from being removed from the front terminal channels.

DETAILED DESCRIPTION OF THE INVENTION

Figure 1:
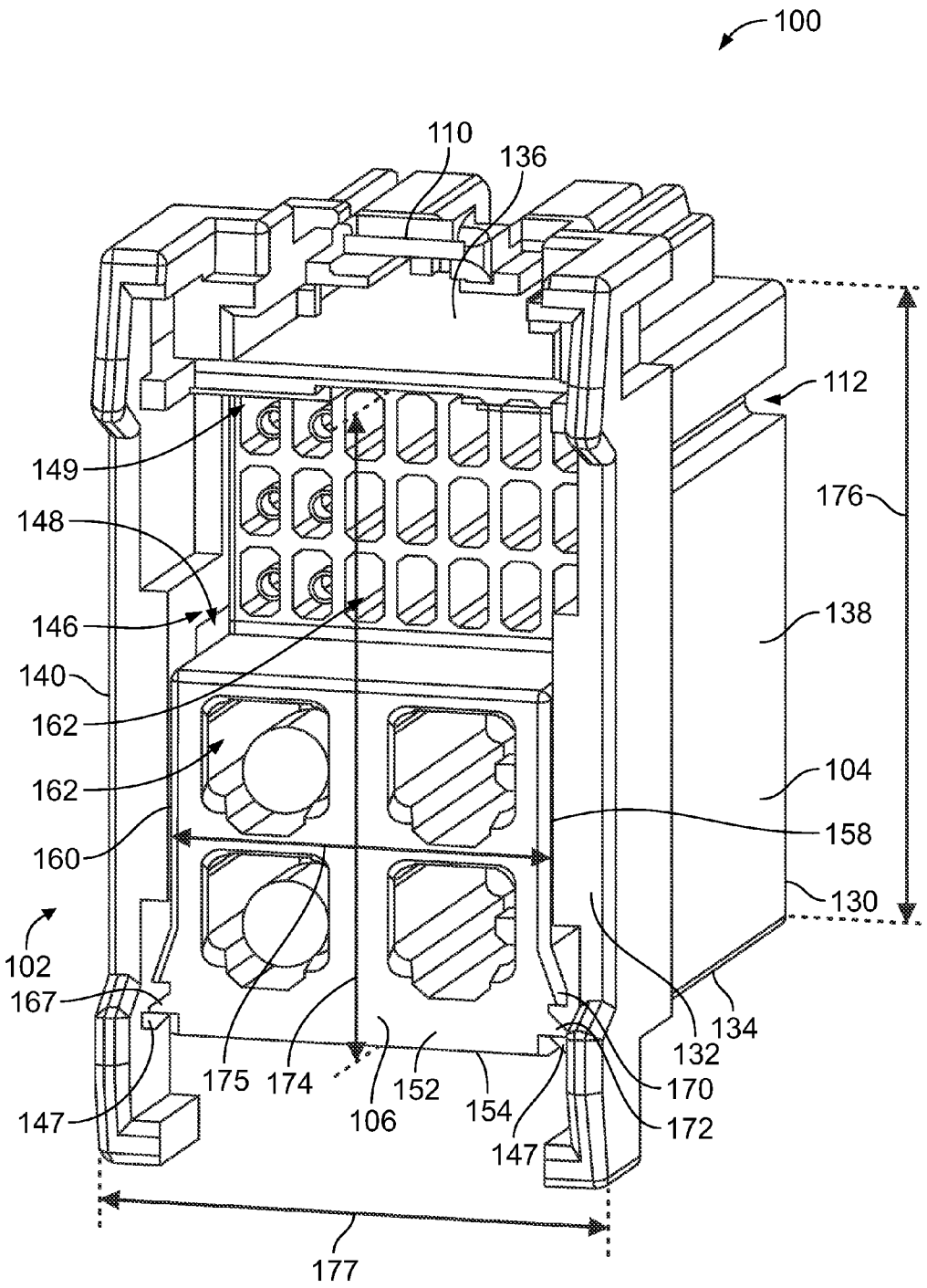
FIG. 1 is a rear perspective of an electrical connector formed in accordance with an exemplary embodiment showing a housing thereof in a closed position.
Figure 3:
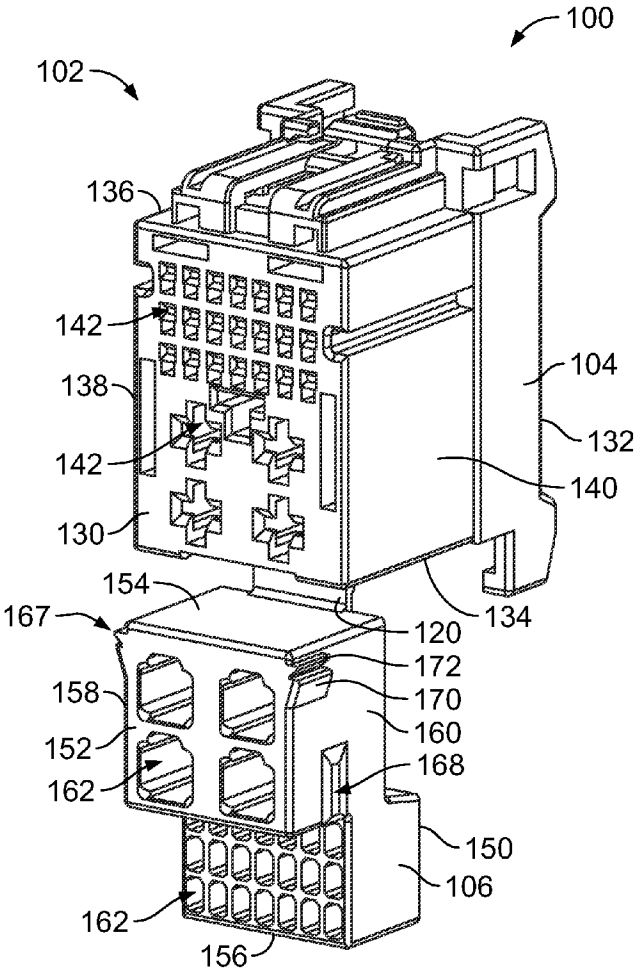
FIG. 3 is a front perspective view of a portion of the electrical connector with the housing in the open position.
Figure 2:
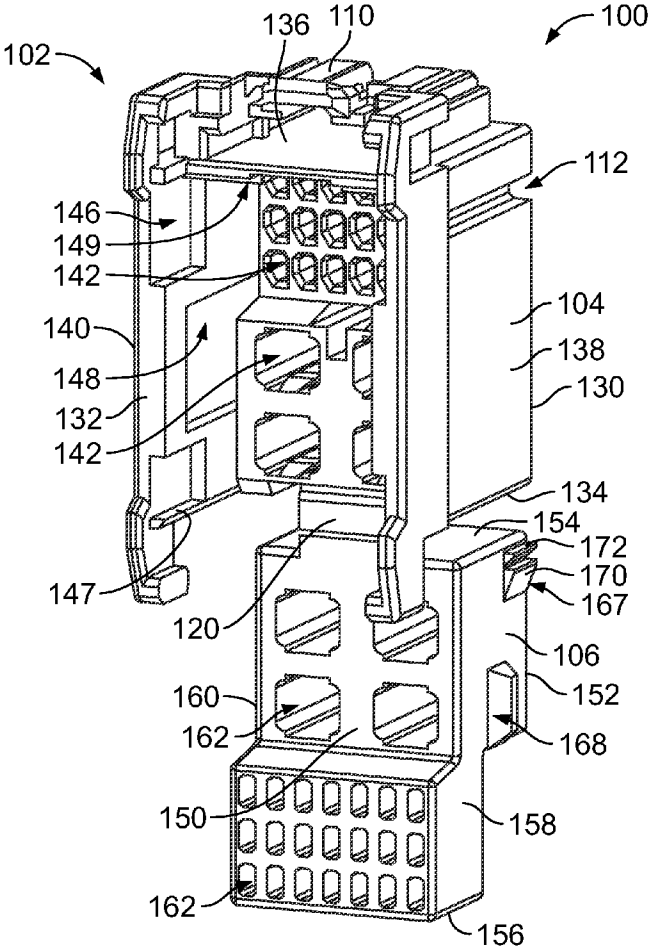
FIG. 2 is a rear perspective view of a portion of the electrical connector with the housing in an open position.

FIG. 1 is a rear perspective of an electrical connector 100 formed in accordance with an exemplary embodiment, showing the electrical connector in a closed position. FIG. 2 is a rear perspective view of a portion of the electrical connector 100 in an open position. FIG. 3 is a front perspective view of a portion of the electrical connector 100 in the open position.

The electrical connector 100 includes a housing 102 having a front housing 104 and a rear housing 106 matable to the front housing 104 to define the housing 102. The electrical connector 100 may be used in an application, such as in an automotive vehicle system, that involves the interconnection of electrical or fiber optic conductors within the system. The electrical connector 100 represents a robust, low cost, compact design. Furthermore, the configuration and arrangement of the electrical connector 100 enables use of simplified design and manufacturing processes, increasing turnover and lowering cost without adversely impacting quality and reliability.

The front housing 104 is configured to hold a plurality of terminals 108 (shown in FIGS. 4 and 5) that are configured to be mated with corresponding mating contacts of a mating connector (not shown). The terminals 108 are terminated to ends of cables 109 (shown in FIGS. 4 and 5). For example, the terminals 108 may be crimped to the cables 109; however the terminals 108 may be terminated by other processes, such as soldering, insulation displacement, poke-in, and the like.

In an exemplary embodiment, the rear housing 106 is used to guide the terminals 108 into the front housing 104 during assembly. For example, the terminals 108 are loaded into the front housing 104 through the rear housing 106. The terminals 108 are held in the front housing 104 for mating with the mating terminals of the mating connector and the cables 109 exit the housing 102 from the rear housing 106. The rear housing 106 may surround portions of the terminals 108.

A housing latch 110 is used to secure the electrical connector 100 to the mating connector. In the illustrated embodiment, the housing latch 110 extends from the front housing 104. Alternatively, the housing latch 110 may extend from the rear housing 106.

The housing 102 includes alignment features 112 that are used to align the electrical connector 100 with respect to the mating connector during mating of the electrical connector 100 to the mating connector. Optionally, the alignment features 112 may constitute keying features, wherein the electrical connector 100 may be mated with the mating connector in a single orientation, defined by the alignment features 112. For example, the vertical positions of the alignment features 112 on the sides of the housing 102 may be varied to define different interfaces. The alignment features 112 may be slots formed in the sides.

In an exemplary embodiment, when the housing 102 is manufactured, the front housing 104 and the rear housing 106 are molded as a single piece with a hinge member 120 (FIGS. 2 and 3) connecting the front housing 104 and the rear housing 106. The hinge member 120 may be a living hinge. The hinge member 120 may be a double hinge that is configured to hinge or flex at two different locations. The hinge member 120 allows the rear housing 106 to rotate relative to the front housing 104 between the open and closed positions. The front housing 104, rear housing 106 and hinge member 120 are a unitary one-piece dielectric structure. The housing 102 is molded with the rear housing 106 in the open position. At some time after molding, such as prior to shipping, the hinge member 120 allows the rear housing 106 to rotate to the closed position. Having the front housing 104 and the rear housing 106 co-molded at the same time using the same mold allows a greater volume of housings 102 to be manufactured.

The front housing 104 is manufactured from a dielectric material. The front housing 104 includes a front 130, a rear 132, an inner end 134, an outer end 136 and opposite sides 138, 140. The rear 132 may be non-planar, such as to accommodate different sized terminals 108 between the front 130 and the rear 132. The front housing 104 is connected to the hinge member 120 at the inner end 134. The front housing 104 has a plurality of front terminal channels 142 extending between the front 130 and the rear 132. The front terminal channels 142 are arranged in a plurality of rows and a plurality of columns. Any number of front terminal channels 142 may be provided, corresponding to the number of terminals 108 (shown in FIG. 4) of the electrical connector 100. The front terminal channels 142 are configured to receive corresponding terminals 108 therein. The terminals 108 are configured to be secured in the front terminal channels 142, such as by latches, which may be part of the front housing 104 or part of the terminals 108.

The front housing 104 includes a rear cavity 146. The rear housing 106 is received in the rear cavity 146 when the rear cavity 106 is rotated to the closed position. The front housing 104 includes securing features 147, 148, 149 that are configured to engage the rear housing 106 to securely couple the rear housing 106 to the front housing 104. Any number of securing features may be provided. The securing features 147, 148, 149 hold vertical and/or horizontal positions of the rear housing 106 relative to the front housing 104. For example, the securing features 147, 148, 149 may restrict the rear housing 106 from moving rearward, from moving downward, from rotating out of the rear cavity 146, and the like.

In an exemplary embodiment, the securing features 147 constitute protrusions or catches 147 along an interior of the rear cavity 146, such as along the sides 138, 140. The securing features 147 are located near the inner end 134. The securing features 147 are oriented horizontally, such as parallel to the inner end 134. The securing features 147 are wedge shaped, however the securing features 147 may have other shapes in alternative embodiments. The securing features 148 may be located elsewhere in alternative embodiments.

In an exemplary embodiment, the securing features 148 constitute pockets 148 open to the rear cavity 146 and extending along the sides 138, 140. In the illustrated embodiment, the securing features 148 are located approximately centered between the inner end 134 and the outer end 136. The securing features 148 may be located elsewhere in alternative embodiments.

In an exemplary embodiment, the securing features 149 constitute pockets 149 open to the rear cavity 146 and extending along the top of the rear cavity 146. The securing features 149 may be located elsewhere in alternative embodiments.

The rear housing 106 is manufactured from a dielectric material. The rear housing 106 includes a front 150, a rear 152, an inner end 154, an outer end 156 and opposite sides 158, 160. The front 150 and/or the rear 152 may be non-planar, such as to fit into the rear cavity 146. The rear housing 106 is connected to the hinge member 120 at the inner end 154. The front housing 104 has a plurality of rear terminal channels 162 extending between the front 150 and the rear 152. The terminal channels 162 are configured to be aligned with the front terminal channels 142 when the rear housing 106 is rotated to the closed position to allow assembly by loading of the terminals 108 into the front terminal channels 162 through the rear terminal channels 162.

The rear housing 106 includes securing features 167, 168 that are configured to interact with the securing features 147, 148, respectively to securely couple the rear housing 106 to the front housing 104. In an exemplary embodiment, the securing features 167 constitute latches 167 configured to engage the corresponding catch 147. The securing features 167 are provided on the sides 158, 160, such as at or near the inner end 154. The securing features 167 are oriented horizontally, such as parallel to the inner end 154. In an exemplary embodiment, the securing features 167 are configured to be held by the securing feature 147 in multiple positions. For example, the rear housing 106 may be movable relative to the front housing 104 between a first stage and a second stage. Optionally, the rear housing 106 may be in an unlocked position (FIG. 4) in the first stage and in a locked position (FIG. 5) in the second stage. The rear housing 106 is closed in both stages; however the rear housing 106 moves between the locked and unlocked positions, such as to lock the terminals 108 in the housing 102. The rear housing 106 may be movable in a vertical direction between the first and second stages (e.g. between the unlocked and locked positions). The hinge member 120 allows the rear housing 106 to move between the first and second stages. Each latch 167 may have a first step 170 and a second step 172, which allow the staged locking of the rear housing 106 to the front housing 104. The first step 170 engages the catch 147 in the first stage and the second step 172 engages the catch 147 in the second stage. The steps 170, 172 may be wedge shaped. The securing features 167 may have other shapes or configurations in alternative embodiments. Optionally, the securing features 147 of the front housing 104 may have multiple steps rather than the securing features 167, while still providing the staged locking of the rear housing 106 to the front housing 104. The securing features 167 may be located elsewhere in alternative embodiments. The engagement between the securing features 147 of the front housing 104 and the securing features 167 of the rear housing 106 holds a vertical position of the rear housing 106 with respect to the front housing 104, such as at multiple stages or positions.

In an exemplary embodiment, the securing features 168 constitute ears 168 extending from the sides 158, 160. The ears 168 are received in the pockets 148 and engage the front housing 104 to secure the rear housing 106 in the rear cavity 146. The securing features 168 are provided on the sides 158, 160, such as approximately centered between the inner end 154 and the outer end 156. The securing features 168 are oriented vertically, such as parallel to the rear 152. The securing features 168 may have other shapes or configurations in alternative embodiments. The securing features 168 may be located elsewhere in alternative embodiments. The engagement between the securing features 148 of the front housing 104 and the securing features 168 of the rear housing 106 holds rearward movement of the rear housing 106 with respect to the front housing 104, such as to stop the rear housing 106 from rotating out of the rear cavity 146.

In the open position (FIGS. 2 and 3), the inner ends 134, 154 face one another with the hinge member 120 therebetween. During assembly, the rear housing 106 is rotated about the hinge member 120 and pressed into the rear cavity 146 of the front housing 104. When closed (FIG. 1), the front housing 104 defines a front of the housing 102 and the rear housing 106 defines a rear of the housing 102. Optionally, portions of the front housing 104 may surround the rear housing 106 and extend to the rear of the housing 102. For example, the front housing 104 may cover the outer end 156 and the sides 158, 160 of the rear housing 106. The front 150 of the rear housing 106 may abut against the rear 132 of the front housing 104 in the closed position. Optionally, the rear housing 106 may be a significant portion of the housing 102. For example, the rear housing 106 may be approximately half of a volume of the housing 102. Optionally, the rear housing 106 may have a height 174 and a width 175 approximately equal to a height 176 and a width 177 of the front housing 104. Optionally, the front housing 104 may be slightly taller and wider than the rear housing 106, such as to define the rear cavity 146 and to receive the rear housing 106 therein.

Figure 5:
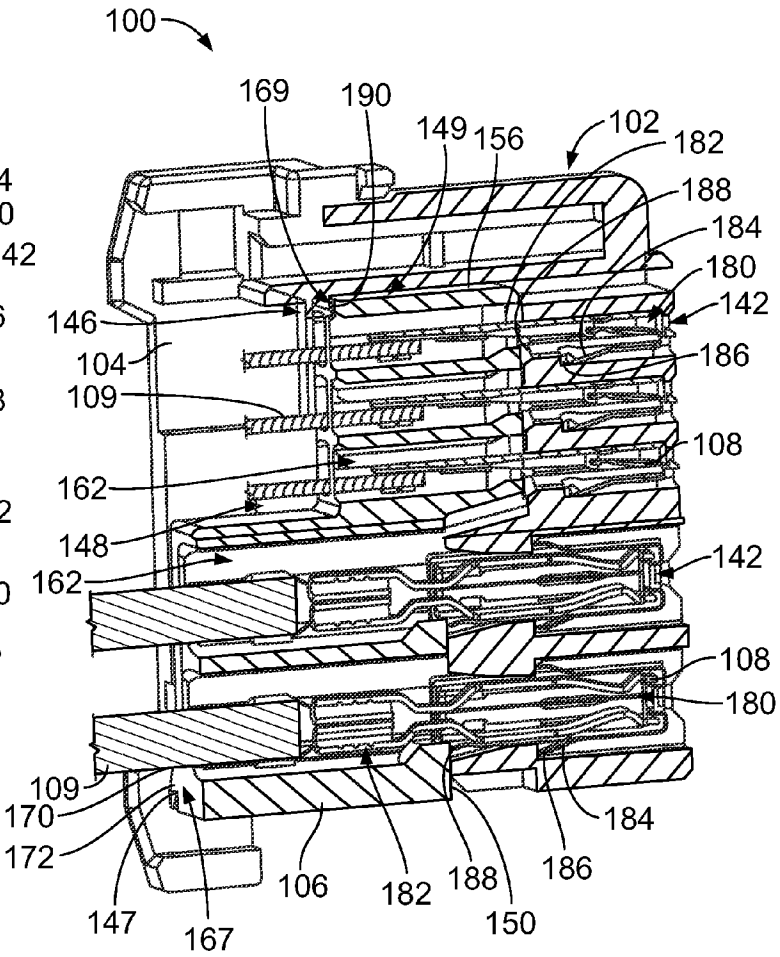
FIG. 5 is a cross-sectional view of the electrical connector showing the housing in a closed, locked position.
Figure 4:
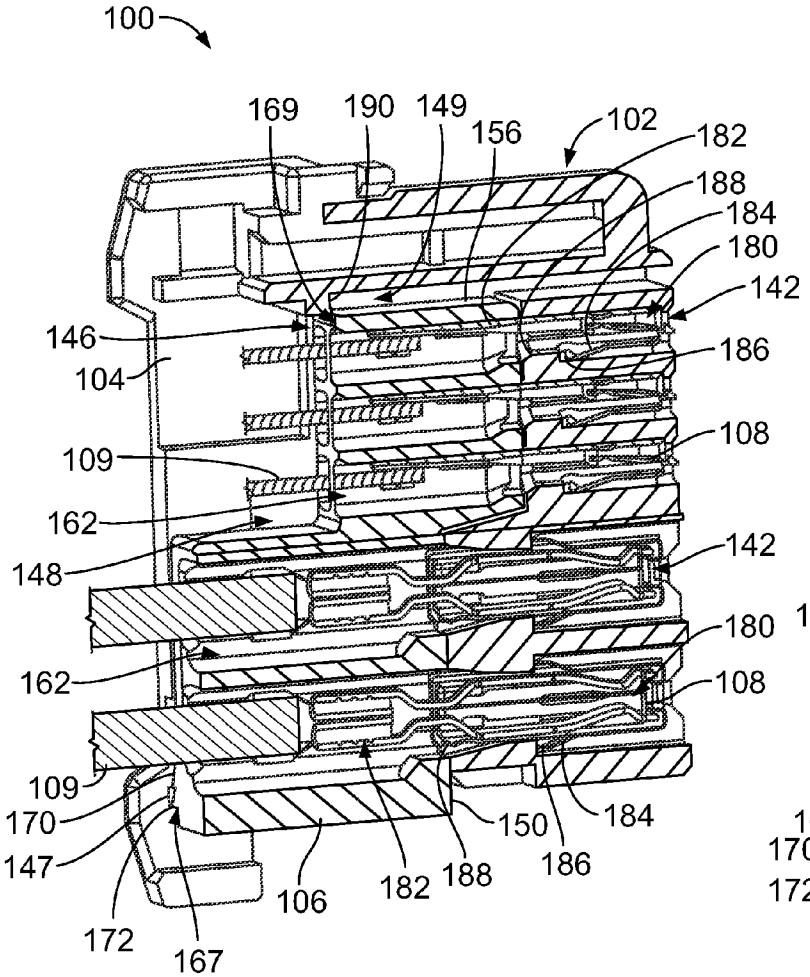
FIG. 4 is a cross-sectional view of the electrical connector showing the housing in a closed, unlocked position.

FIG. 4 is a cross-sectional view of the electrical connector 100 showing the housing 102 in a closed, unlocked position. FIG. 5 is a cross-sectional view of the electrical connector 100 showing the housing 102 in a closed, locked position. The terminals 108 are shown loaded into the front terminal channels 142. In an exemplary embodiment, the housing 102 includes different sized terminal channels 142, 162 for receiving different sized terminals 108, which may be used for different purposes, such as for transmitting signal and power.

During assembly, the rear housing is rotated to the closed, unlocked position and held in such position by the securing features 147, 148 (shown in FIGS. 2-3) of the front housing 104 and the securing features 167, 168 (shown in FIGS. 2-3) of the rear housing 106. The securing features 167, such as the first steps 170, engage the catch 147 to hold the rear housing 106 in the first stage (e.g. the unlocked position). The securing features 167 hold the vertical position of the rear housing 106 relative to the front housing 104. The securing features 168, the ears 168, are received in the pockets 148 and hold the horizontal position of the rear housing 106 relative to the front housing 104. For example, the securing features 168 engage a lip or wall defining the pockets 148 to stop the rear housing 106 from moving rearward and/or from rotating out of the rear cavity 146. In the unlocked position, the rear housing 106 does not engage the securing feature 149. For example, the rear housing 106 is not received in the pocket 149. Clearance is provided between the rear housing 106 and the edge or wall defining the rear side of the pocket 149, such as to allow the rear housing 106 to be rotated into the closed position.

After the rear housing 106 is rotated to the closed, unlocked position, the rear terminal channels 162 are aligned with the front terminal channels 142 such that the terminals 108 may be freely loaded into the front terminal channels 142 through the rear terminal channels 162. The terminals 108 are unobstructed when the rear housing 106 is in the unlocked position. The terminals 108 are simply loaded in a loading direction through the rear terminal channels 162 into the front terminal channels 142 to fully loaded positions. In the closed but unlocked position, the terminals 108 are also allowed to be removed from the front terminal channels 142 through the rear terminal channels 162.

The terminals 108 have sockets 180 at front ends thereof, which are configured to be positioned in the front terminal channels 142 for mating with corresponding mating contacts, for example pins, of the mating connector (not shown). Optionally, portions of the terminals 108 may remain in the rear terminal channels 162 in the fully loaded positions. For example, cable ends 182, which may have crimp barrels, may be provided at the rear ends of the terminals 108. The cable ends 182 may at least partially extend into the rear terminal channels 162. In the illustrated embodiment, the terminals 108 include latches 184 to secure the terminals 108 in the front terminal channels 142 in the fully loaded positions. The latches 184 engage shoulders 186 formed in the front terminal channels 142 to hold the axial positions of the terminals 108 in the front terminal channels 142. The latches 184 stop rearward movement of the terminals 108 from the front terminal channels 142. In alternative embodiments, the front housing 104 may include deflectable latches that extend into the front terminal channels 142 to secure the terminals 108 in the front terminal channels 142.

After all of the terminals 108 are fully loaded into the housing 102, the rear housing 106 may be transferred to the locked position (FIG. 5). For example, the rear housing 106 may be pressed upward, loading the rear housing 106 further into the rear cavity 146. The rear housing 106 operates as a secondary lock for the terminals 108 that is used as a backup locking feature for securing the terminals 108 within the front terminal channels 142. For example, when the rear housing 106 is moved to the locked position, the front 150 of the rear housing 106 may block portions of the terminals 108 and stop the terminals 108 from retracting out of the front terminal channels 142. For example, the front 150 of the rear housing 106 may be aligned with and block the front terminal channels 142 to restrict removal of the terminals 108. The rear terminal channels 162 are at least partially offset relative to the front terminal channels 142 to restrict the terminals 108 from being removed from the front terminal channels 142. For example, the terminals 108 may have rear edges 188, such as at the rear of the sockets 180, that are blocked (e.g. abut against) by front 150 of the rear housing 106.

Optionally, the rear housing 106 may be used as a terminal position assurance device, assuring that the terminals 108 are fully loaded into the front terminal channels 142 during assembly. For example, when one of the terminals 108 is not fully loaded, the rear housing 106 may not be able to move from the unlocked position to the locked position, giving an indication to the assembler that such terminal(s) 108 is not fully loaded into the corresponding front terminal channel 142.

In the locked position (FIG. 5), the securing features 147, 148, 149 (shown in FIGS. 2-3) of the front housing 104 interact with the securing features 167, 168, 169 of the rear housing 106. The securing features 167, such as the second steps 172, engage the catches 147 to hold the rear housing 106 in the second stage (e.g. the locked position). The securing features 167 hold the vertical position of the rear housing 106 relative to the front housing 104. The securing features 168, the ears 168, remain in the pockets 148, and may be moved vertically in the pockets 148 as the rear housing 106 is pushed upward to the locked position, and hold the horizontal position of the rear housing 106 relative to the front housing 104. For example, the securing features 168 engage a lip or wall defining the pockets 148 to stop the rear housing 106 from moving rearward and/or from rotating out of the rear cavity 146. In the locked position, the securing feature 169 of the rear housing 106 engages the securing feature 149. For example, the outer end 156 of the rear housing 106 is pushed upward into the pocket 149 and the rear edge of the rear housing 106, which defines the securing feature 169, is blocked by a ledge 190, defined by the lip or wall defining the pocket 149. The securing features 149, 169 hold the horizontal position of the rear housing 106 relative to the front housing 104. For example, the securing features 149, 169 stop the rear housing 106 from moving rearward and/or from rotating out of the rear cavity 146.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a housing including a front housing and a rear housing matable to define the housing, wherein the front housing and the rear housing are molded as a single piece with a hinge member connecting the front housing and the rear housing, the rear housing rotatable about the hinge member from an open position to a closed position, wherein the front and rear housings include multi-stage securing features engaged when the front and rear housings are in the closed position, the securing feature of the front housing comprises a catch, the securing feature of the rear housing comprises a latch having a first step and a second step;

the front housing having front terminal channels configured to receive terminals, the rear housing having rear terminal channels aligned with the front terminal channels when the rear housing is rotated to the closed position but not aligned with the front terminal channels when the rear housing is in the open position, wherein the rear housing is movable relative to the front housing in the closed position between a clearance position and a blocking position with the securing features engaging each other in the clearance position and in the blocking position, wherein the first step engages the catch in a first stage when the rear housing is in the clearance position, and the second step engages the catch in a second stage when the rear housing is in the blocking position, the rear housing moving relative to the front housing between the first stage and the second stage, and wherein, in the clearance position, the rear terminal channels are configured to allow the terminals to at least partially pass therethrough into the front terminal channels during loading of the terminals into the housing, and wherein, in the blocking position, the rear terminal channels are offset from the front terminal channels such that the rear housing blocks the terminals from backing out of the front terminal channels.

2. The electrical connector of claim 1, wherein the front housing includes a front, a rear, an inner end, an outer end, and opposite sides, and wherein the rear housing includes a front, a rear, an inner end, an outer end, and opposite sides, the inner ends of the front housing and the rear housing facing one another in the open position with the hinge member extending between the inner end of the front housing and the inner end of the rear housing.

3. The electrical connector of claim 1, wherein the front housing includes a front, a rear, an inner end, an outer end, and opposite sides, and wherein the rear housing includes a front, a rear, an inner end, an outer end, and opposite sides, the front housing having a rear cavity, the rear housing being rotated into the rear cavity as the rear housing is rotated to the closed position.

4. The electrical connector of claim 1, wherein the front housing includes a front, a rear, an inner end, an outer end, and opposite sides, and wherein the rear housing includes a front, a rear, an inner end, an outer end, and opposite sides, the front of the rear housing abutting against the rear of the front housing when the rear housing is rotated to the closed position, the housing configured to receive the terminals through the rear terminal channels into the front terminal channels through the rear of the rear housing.

5. The electrical connector of claim 1, wherein, after the rear housing is moved to the closed position, the rear housing is movable from an unlocked position to a locked position, wherein, in the unlocked position, the rear terminal channels are aligned with the front terminal channels to allow terminals to freely pass between the rear terminal channels and the front terminal channels, and wherein, in the locked position, the rear terminal channels are at least partially offset relative to the front terminal channels to restrict the terminals from being removed from the front terminal channels.

6. The electrical connector of claim 5, wherein, in the locked position, a front of the rear housing at least partially blocks the front terminal channels to block the terminals from retracting from the front terminal channels.

7. The electrical connector of claim 5, wherein the front housing includes a pocket defined by a ledge, in the unlocked position, the rear housing is located outside of the pocket, in the locked position, the rear housing is received in the pocket, in the locked position, the ledge blocks the rear housing from moving rearward.

8. The electrical connector of claim 1, wherein the securing feature of the front housing comprises a catch, the securing feature of the rear housing comprises a latch having a first step and a second step, the first step engaging the catch in a first stage when the rear housing is in the clearance position, the second step engaging the catch in a second stage when the rear housing is in the blocking position, the rear housing moving relative to the front housing between the first stage and the second stage.

9. The electrical connector of claim 1, wherein the engagement between the securing feature of the front housing and the securing feature of the rear housing holds the rear housing at different vertical positions with respect to the front housing.

10. The electrical connector of claim 1, wherein the engagement between the securing feature of the front housing and the securing feature of the rear housing blocks rearward movement of the rear housing with respect to the front housing.

11. The electrical connector of claim 1, wherein the front housing, the rear housing and the hinge member are a unitary one-piece dielectric structure.

12. The electrical connector of claim 1, wherein the rear housing is approximately half of a volume of the housing.

13. The electrical connector of claim 1, wherein the rear housing has a height and a width approximately equal to a height and a width of the front housing.

14. The electrical connector of claim 1, wherein the rear housing is shifted from the clearance position to the blocking position in a direction non-parallel to axes of the rear terminal channels.

15. An electrical connector comprising:

a housing including a front housing and a rear housing matable to define the housing, wherein the front housing and the rear housing are molded as a single piece with a hinge member connecting the front housing and the rear housing, the rear housing rotatable about the hinge member from an open position to a closed position, wherein the front and rear housings include multi-stage securing features engaged when the front and rear housings are in the closed position, the securing feature of the front housing comprises a catch, the securing feature of the rear housing comprises a latch having a first step and a second step;

the front housing having front terminal channels configured to receive terminals, the rear housing having rear terminal channels aligned with the front terminal channels when the rear housing is rotated to the closed position but not aligned with the front terminal channels when the rear housing is in the open position;

wherein, after the rear housing is moved to the closed position, the rear housing is movable from an unlocked position to a locked position, wherein, in the unlocked position, the catch engages the first step of the latch and the rear terminal channels are aligned with the front terminal channels to allow terminals to freely pass between the rear terminal channels and the front terminal channels, and wherein, in the locked position, the catch engages the second step of the latch and the rear terminal channels are offset from the front terminal channels such that the rear housing blocks the terminals from being removed from the front terminal channels.

16. The electrical connector of claim 15, wherein the front housing includes a front, a rear, an inner end, an outer end, and opposite sides, and wherein the rear housing includes a front, a rear, an inner end, an outer end, and opposite sides, the inner ends of the front housing and the rear housing facing one another in the open position with the hinge member extending between the inner end of the front housing and the inner end of the rear housing.

17. The electrical connector of claim 15, wherein the front housing includes a front, a rear, an inner end, an outer end, and opposite sides, and wherein the rear housing includes a front, a rear, an inner end, an outer end, and opposite sides, the front housing having a rear cavity, the rear housing being rotated into the rear cavity as the rear housing is rotated to the closed position.

18. The electrical connector of claim 15, wherein, in the locked position, a front of the rear housing at least partially blocks the front terminal channels to block the terminals from retracting from the front terminal channels.

19. The electrical connector of claim 15, wherein the rear housing is shifted in a direction non-parallel to axes of the rear terminal channels as the rear housing is moved from the unlocked position to the locked position.

* * * * *